United States Patent [19]

Oldfield

[11] 4,244,549

[45] Jan. 13, 1981

[54] SELF STRAIGHTENING PICTURE HANGER

[76] Inventor: Clifford T. Oldfield, 4119 Vincent St., Pierrefonds, Que., Canada, H9J 1W7

[21] Appl. No.: 902,951

[22] Filed: May 5, 1978

[51] Int. Cl.[3] ..... A47G 1/16

[52] U.S. Cl. ..... 248/494

[58] Field of Search ..... 248/489, 492, 493, 494, 248/495

[56] References Cited

U.S. PATENT DOCUMENTS

| | | | |
|---|---|---|---|
| 373,707 | 11/1887 | Wiegand | 248/495 |
| 1,944,203 | 1/1934 | Wittig | 248/494 |
| 2,180,211 | 11/1939 | Kellogg | 248/493 |
| 2,419,398 | 4/1947 | Golden | 248/494 |

FOREIGN PATENT DOCUMENTS

| | | | |
|---|---|---|---|
| 1031754 | 5/1978 | Canada | 248/495 |

*Primary Examiner*—William H. Schultz

[57] ABSTRACT

A self straightening hanger is rectangular in shape with three holes located on the horizontal center line equally spaced. The outboard holes are used to thread the existing wire at the back of the picture through these holes and provide a means of retaining the wire in a desired preadjusted position. The center hole when placed over the nail supports the picture on the wall and provides a pivot allowing the picture to swing freely. Two rollers each with a length of cord attached to one end of each roller are suspended from the outboard holes of the hanger to a point between the wall and the bottom of the picture frame, in order to remove friction between the picture frame and the wall and allow the picture to return to a straight position should the picture be accidently moved.

1 Claim, 2 Drawing Figures

SELF STRAIGHTENING PICTURE HANGER

The present invention relates in general to a device for hanging objects such as pictures, mirrors or the like upon a wall and employs a very simple mechanism for fixing the inclination of the object with respect to the horizontal.

It is known that various types of adjustable hangers or the like have been developed to this end.

These prior art devices are commonly relatively complicated. They require more than one nail or fastener to secure the picture to the wall and are normally relatively expensive because of the necessary complexity thereof.

My invention consists of a self straightening picture hanger of the type adapted to be threaded on to the usual wire and hook method of the picture hanging. Two rollers suspended from the above mentioned hanger to a point between the picture and the wall to eliminate friction between wall and picture. The rollers insure the hanging of the picture in balance by utilizing gravity to return the picture to the desired position if it is moved by accidental striking or from vibrations.

I have discovered that it is necessary to have a type of hanger that will retain the wire supporting the picture and keep it from slipping on the nail that supports said hanger and two rollers between the wall and picture to keep the picture in a constant state of balance.

In the drawing which illustrates embodiments of the invention

Figures 1, 2:
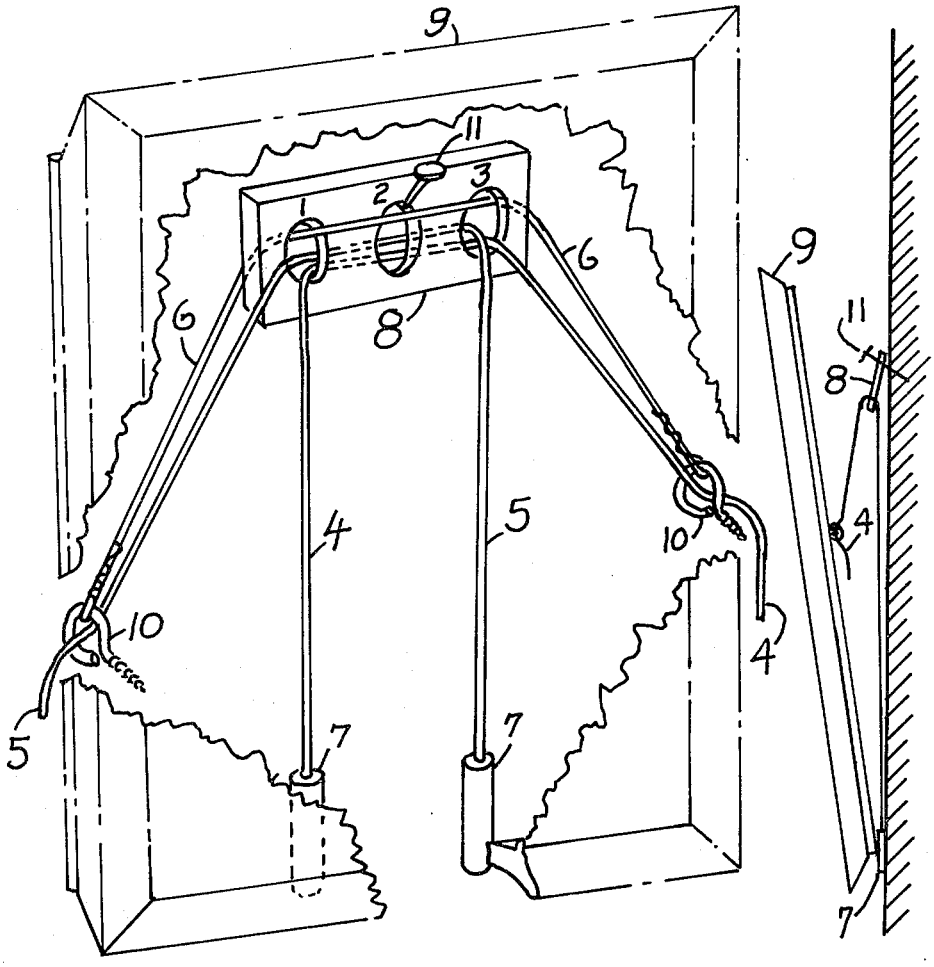
FIG. 1 is a front elevation, in perspective, of a picture on the wall having the hanger and the rollers attached thereto. The portion of the picture in front of the hanger and rollers being broken away.
FIG. 2 is a side view of the picture and its hanger and rollers mounted on the wall, which is shown in section.

Referring now to the drawing I have shown the device of my invention for use with a conventional Frame 9 having a wire or cord 6 secured by conventional Hooks 10.

My hanger comprises a flat strip of metal or suitable material 8 with three holes 1, 2, 3 equally spaced. The centre holes having a diameter large enough to allow it to be placed over the head of Nail 11. Holes 1 and 3 are used for threading the picture wire 6 and roller attaching cords 4 and 5.

Hole 2 is used to balance the hanger on the nail 11. Roller 7 comprises a tubular shape of metal or other material having attached thereto a string or cord 4 or 5. These cords 4 or 5 are passed through Holes 1 and 3 in a manner best illustrated in FIG. 1 and through R.H. and L.H. picture hooks 10. Cords 4 and 5 are left hanging through picture hooks 10 in order to provide accessibility when the picture is hung on the wall and a method of adjustment of the rollers to the proper position.

After the hanger and rollers are installed on the picture wire the hanger with rollers attached is placed over the nail in the wall using the centre hole. The rollers will be in a down position at the bottom of the frame. Pulling the string at either side of the picture will raise the rollers to the desired position between wall and frame. If one swings the picture gently to one side one will observe that the picture will swing back and forth on the rollers and will always stop at the same inclination with respect to the horizontal. If this is not the desired inclination, grasp the picture with both hands at the sides of the frame and pull to the right or left in order to alter the position of the wire in the hanger holes to a point where the picture will always return to the straight position.

After this adjustment is made no further adjustments should be required.

What is claimed is:

1. A self straightening picture hanger for mounting a picture on a wall, said hanger comprising a generally rectangular plate, said plate having three horizontally spaced apertures, the center of said apertures being on the horizontal center line of said plate, a wire secured at opposite ends to a picture frame and threaded through the outboard apertures, said apertures serving to retain said wire in a desired, pre-adjusted position, the center aperture adapted to be placed over the head of a nail and serve as a pivot point, a pair of cords threaded through the outboard apertures, one end of each cord depending from a respective aperture and a roller attached to each depending end, said rollers adapted to be interposed between the picture frame and the wall whereby the frame may roll on the rollers which, in turn, roll on the wall and allow the picture to return to a straight position, if disturbed.

* * * * *